US010306938B2

(12) United States Patent
Kingsmore

(10) Patent No.: US 10,306,938 B2
(45) Date of Patent: Jun. 4, 2019

(54) FITTED BLANKET

(71) Applicant: Robin Lee Kingsmore, Bonaire, GA (US)

(72) Inventor: Robin Lee Kingsmore, Bonaire, GA (US)

( * ) Notice: Subject to any disclaimer, the term of this patent is extended or adjusted under 35 U.S.C. 154(b) by 138 days.

(21) Appl. No.: 14/858,580

(22) Filed: Sep. 18, 2015

(65) Prior Publication Data

US 2016/0128498 A1 May 12, 2016

Related U.S. Application Data

(60) Provisional application No. 62/123,268, filed on Nov. 12, 2014.

(51) Int. Cl.

| | |
|---|---|
| ***A41B 13/06*** | (2006.01) |
| ***A41D 27/20*** | (2006.01) |
| ***A47G 9/06*** | (2006.01) |

(52) U.S. Cl.

CPC ..... *A41D 27/20* (2013.01); *A47G 9/066* (2013.01); *A47G 9/068* (2013.01)

(58) Field of Classification Search

CPC ..... A47G 9/066; A47G 9/068; A41D 3/08; A41D 3/00; A41D 27/20

USPC ..... 2/69.5; 38/97

See application file for complete search history.

(56) References Cited

U.S. PATENT DOCUMENTS

| | | | | |
|---|---|---|---|---|
| 2,227,751 | A | 1/1941 | Idelman | |
| 2,299,202 | A * | 10/1942 | Bass | D06F 75/38 38/141 |
| 4,021,869 | A | 5/1977 | Root | |
| 4,895,171 | A * | 1/1990 | Onik | A61F 13/00 128/869 |
| 5,662,372 | A * | 9/1997 | Lubkeman | A41D 3/08 150/166 |
| 7,246,392 | B2 | 7/2007 | Schmid | |
| 8,464,374 | B1 | 6/2013 | Thayer | |
| 8,601,621 | B2 | 12/2013 | Aprile | |
| 8,793,813 | B2 | 8/2014 | Waters | |
| 8,898,835 | B2 | 12/2014 | Khan | |
| 2003/0037362 | A1* | 2/2003 | Dodge | A41D 3/08 2/69 |
| 2006/0285774 | A1* | 12/2006 | Carmody | B65F 1/0006 383/4 |
| 2007/0061965 | A1* | 3/2007 | Crawford | A47G 9/066 5/413 R |
| 2008/0066229 | A1 | 3/2008 | Auer | |
| 2014/0217081 | A1 | 8/2014 | Dewitt | |

* cited by examiner

*Primary Examiner* — Timothy K Trieu

(74) *Attorney, Agent, or Firm* — Clements Bernard Walker PLLC; Richard A. Walker

(57) ABSTRACT

A fitted blanket for use in a variety of contexts, including home, outdoor activities, school and in healthcare facilities, to enclose a human body may include a generally curvilinear triangle shaped bag with a front side and a back side defining an interior enclosure, a top portion with two shoulder areas and a bottom portion with a foot area. A generally oval opening may be defined in the back side with two openings in the front side. The fitted blanket may include elastic edges along the perimeter of the oval opening to secure the blanket around the user.

9 Claims, 6 Drawing Sheets

FITTED BLANKET

CROSS-REFERENCE TO RELATED APPLICATIONS

This application claims priority to U.S. Provisional App. Ser. No. 62/123,268, filed Nov. 12, 2014 and which is incorporated by reference a if fully set forth, herein.

BRIEF DESCRIPTION OF THE DRAWINGS

An exemplary fitted blanket is described with reference to the accompanying drawings. The elements of the drawings are not necessarily to scale, emphasis instead being placed upon clearly illustrating the novel features.

DETAILED DESCRIPTION

Figure 1:
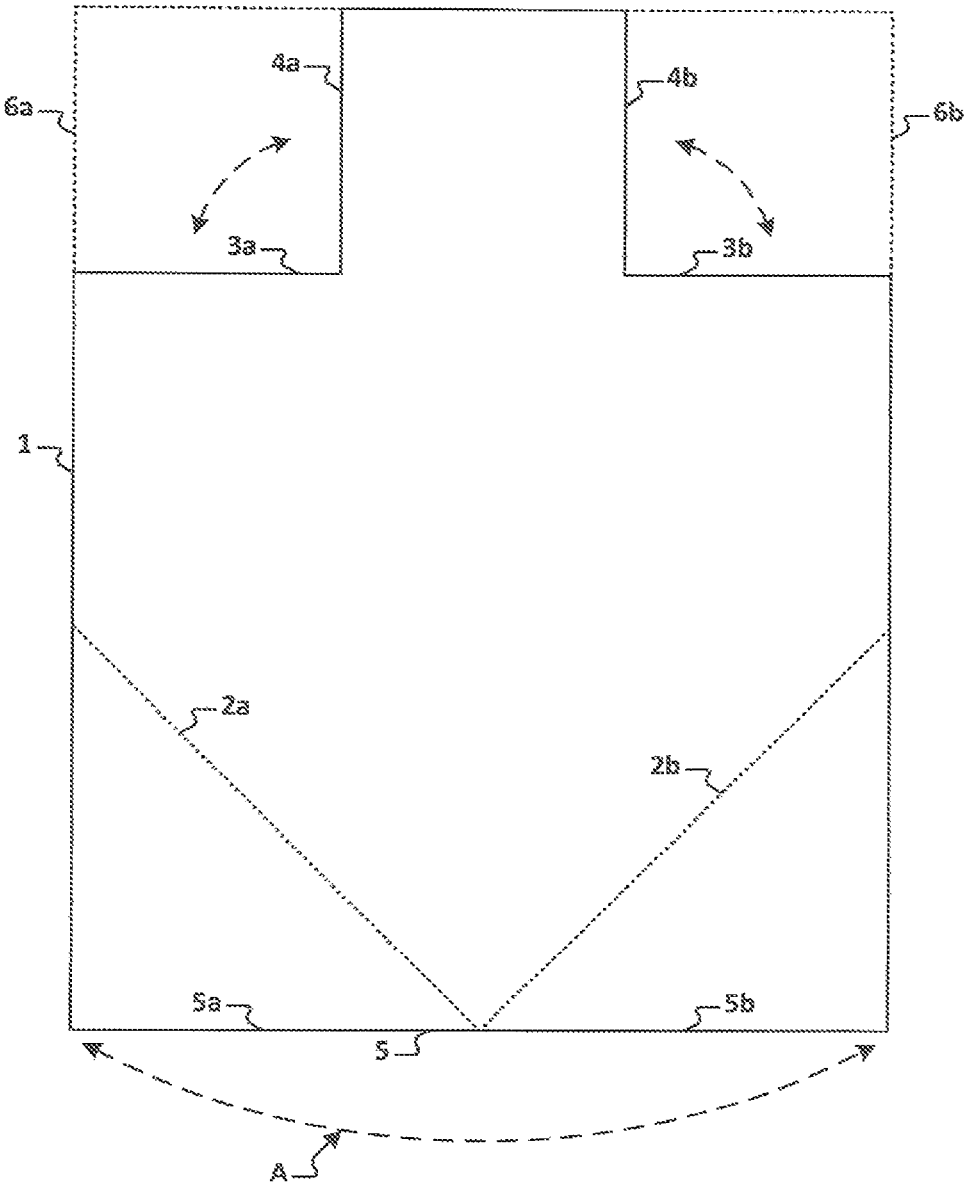
FIG. 1 is a sheet of fabric from which an exemplary blanket is made illustrating the shape of the fabric, prior to forming the blanket.
Figure 3:
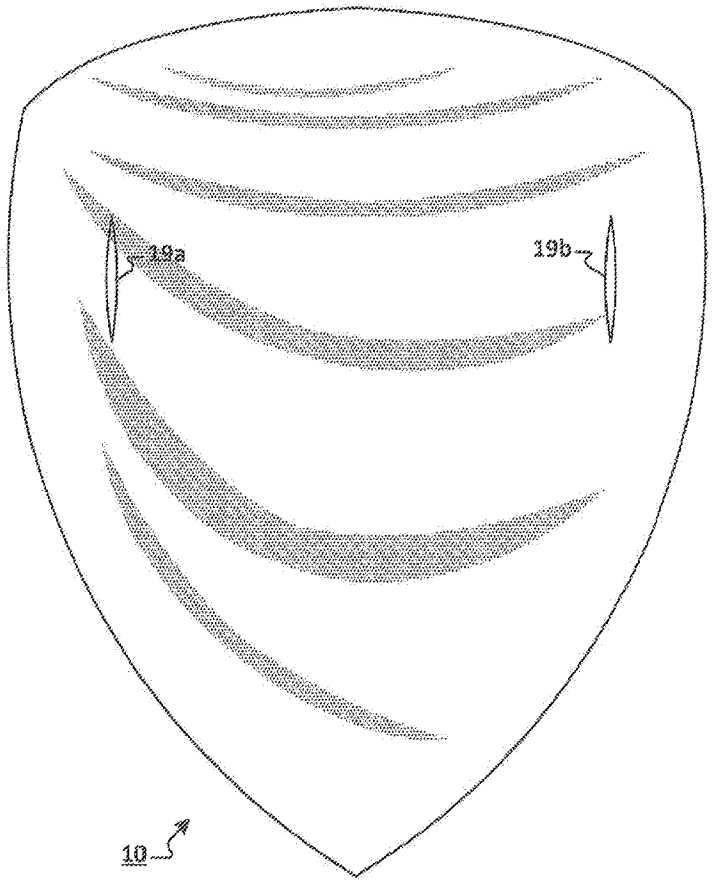
FIG. 3 is a view of the opposing side of the blanket of FIG. 2.

FIG. 1 depicts a portion of fabric 1 from which an exemplary fitted blanket that may be used to enclose a human body is formed. Fabric 1 is a generally rectangular shape with two square sections 6*a*, 6*b* (shown in dotted lines) removed from the adjacent corners of a short side of the rectangle resulting in two adjacent edges 3*a*, 4*a* meeting at a generally perpendicular angle, and two adjacent edges 3*b*, 4*b* identically situated. The opposing corners of the fabric 1 having a common short side 5 are folded together as indicated by reference arrow A, forming folds generally along dotted lines 2*a*, and 2*b*. The corners are made to meet together which divides side 5 into two generally equivalent edges 5*a, b*.

Figure 2:
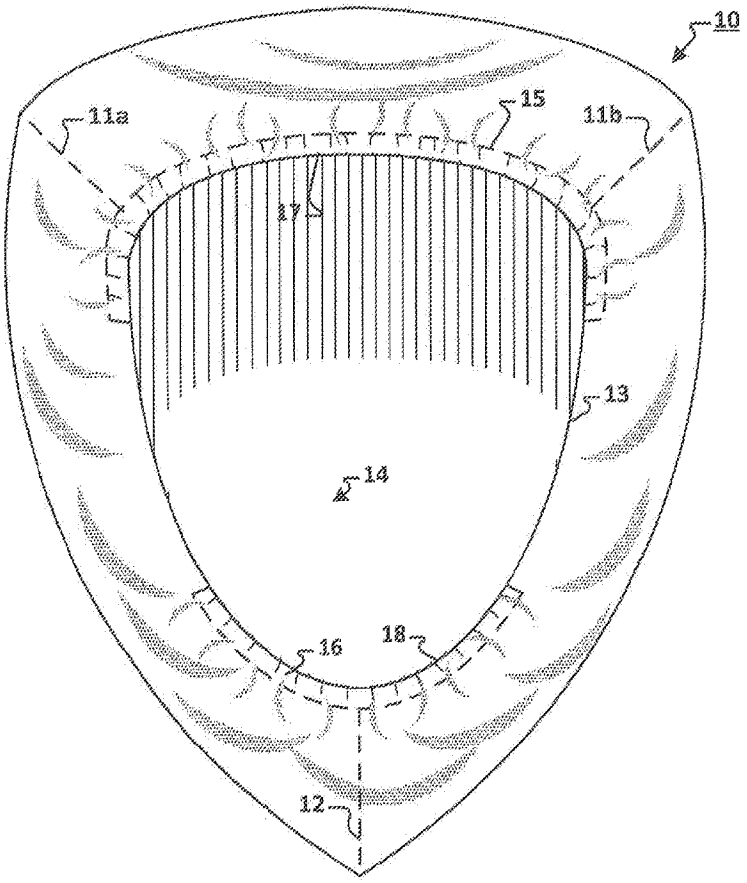
FIG. 2 is a view of one side of an exemplary blanket, formed with the fabric of FIG. 1.

With reference to FIG. 2, edges 3*a* and 4*a* are attached together and edges 3*b*, and 4*b* are attached together resulting in seams 11*a* and 11*b*. Edges 5*a* and 5*b* are attached together forming seam 12. The resulting structure is a generally curvilinear triangle bag that includes a generally ovoid opening 13 defined in the back of the structure, having an inverted generally ogive shape defining the lower edge 18, and a rounded upper edge 17 near seams 11*a*, 11*b*. So configured, an interior space 14 is defined in which a user may enclose his or her body. The upper interior of the space in the area proximal to seams 11*a*, 11*b* accommodate a user's shoulders and the lower interior space proximal to seam 12 accommodates a user's legs and feet. A piece of elastic 15 is incorporated into the upper edge 17 and a piece of elastic 16 is likewise incorporated into the lower edge 18.

The type of fabric 1 used will be determined by the need or desire of the user. The fitted blanket may be formed from any suitable fabric, including, but not limited to, woven, unwoven and knit fabrics to accommodate various temperature and weather conditions in multiple settings. The size of fabric 1 may vary according in the size of the intended user, but may be made to accommodate adults and children of various sizes.

Figure 4B:
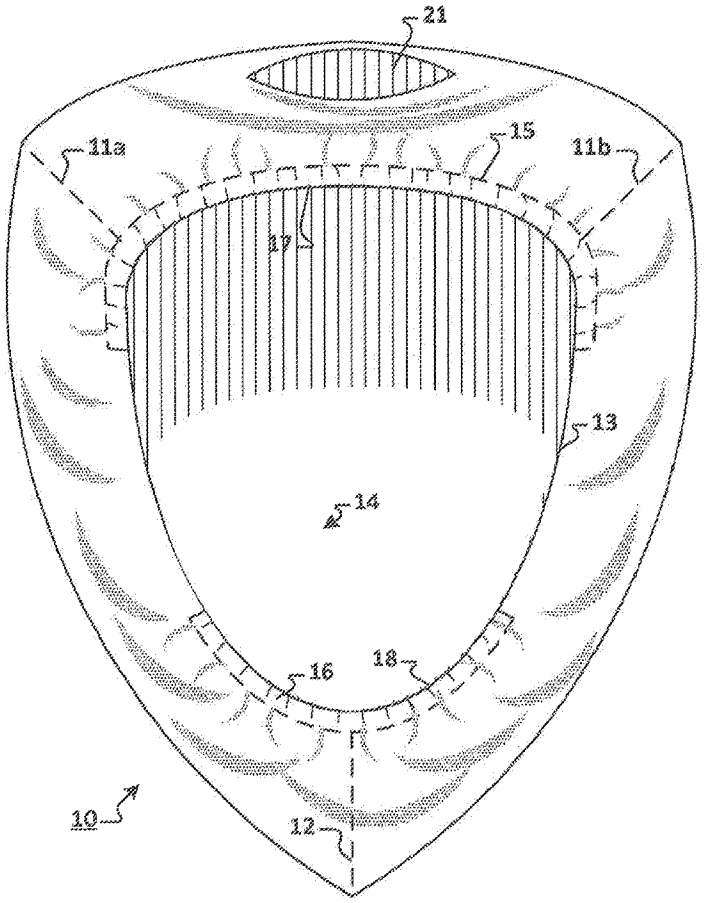
FIGS. 4A & 4B depict alternative embodiments of a fitted blanket.
Figure 4A:
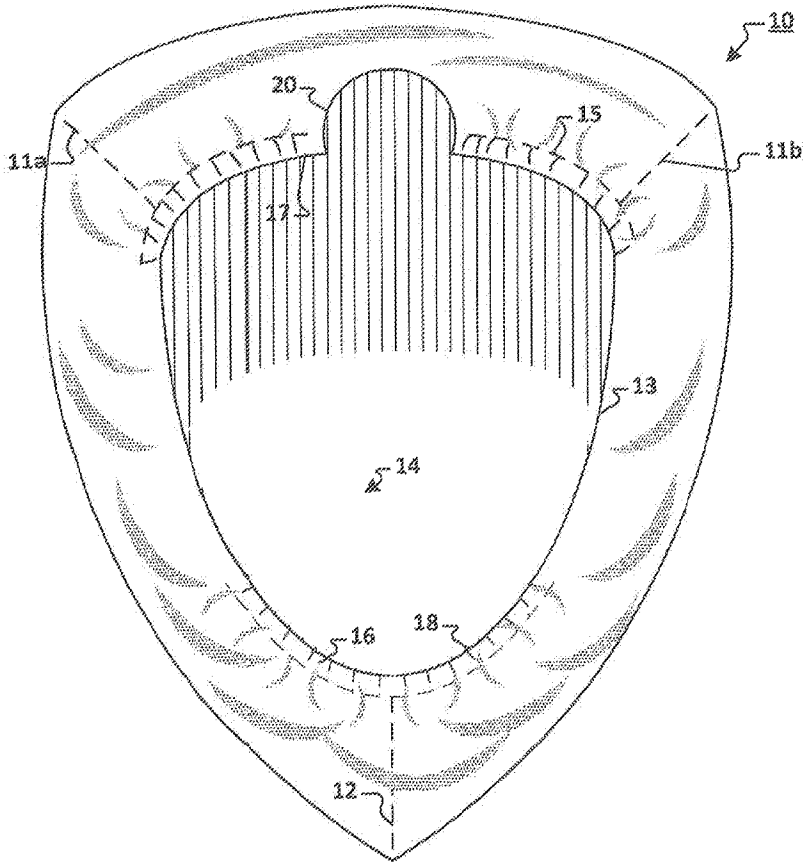
Figure 4C:
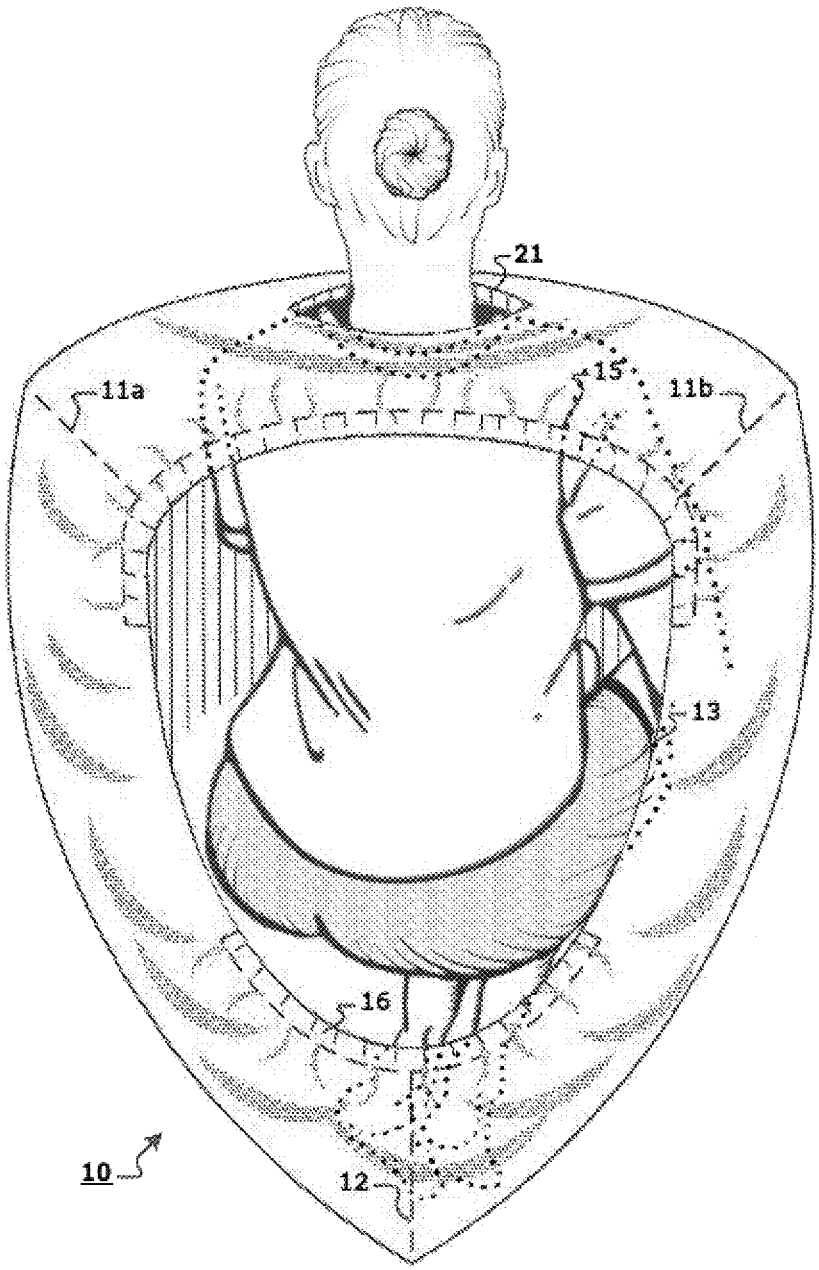
FIG. 4C shows a rear side view of the fitted blanket of FIG. 4B in an example in-use environment, including a human body within an interior enclosure of the fitted blanket.

In another embodiment, slits 19*a*, 19*b* may be formed in the fabric to allow a user's arms to be inserted there through. In further embodiments, illustrated in FIGS. 4A and 4B, a cut-out 20 may be formed in the upper edge 17 of the opening 13 to accommodate a user's neck. In the alternative, an opening 21 may be formed in the upper section of the blanket 10 through which a user may insert his or her head.

Figure 5B:
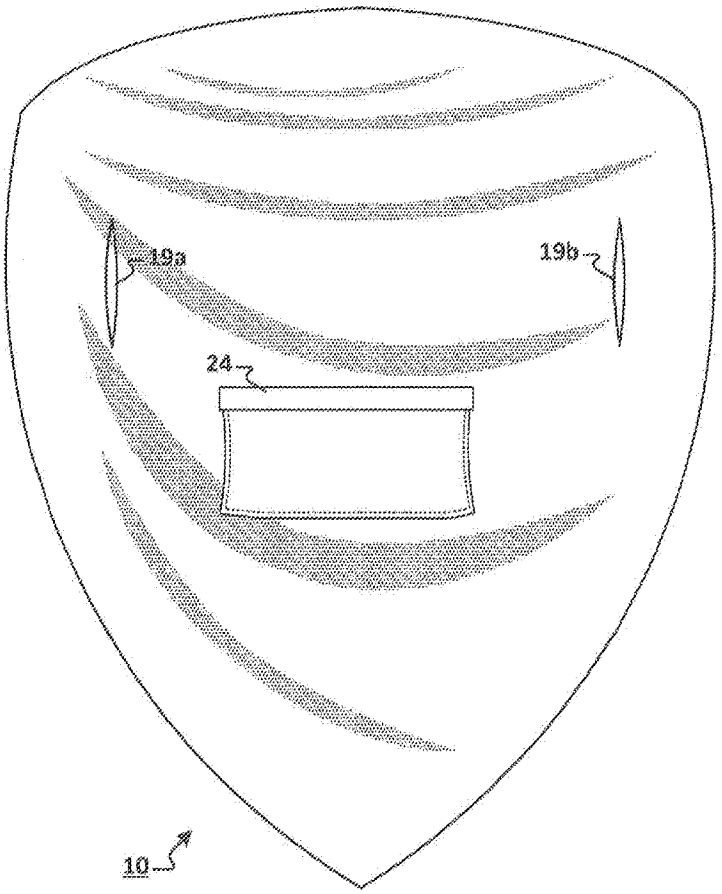
FIGS. 5A & 5B depict further embodiments of a fitted blanket.
Figure 5A:
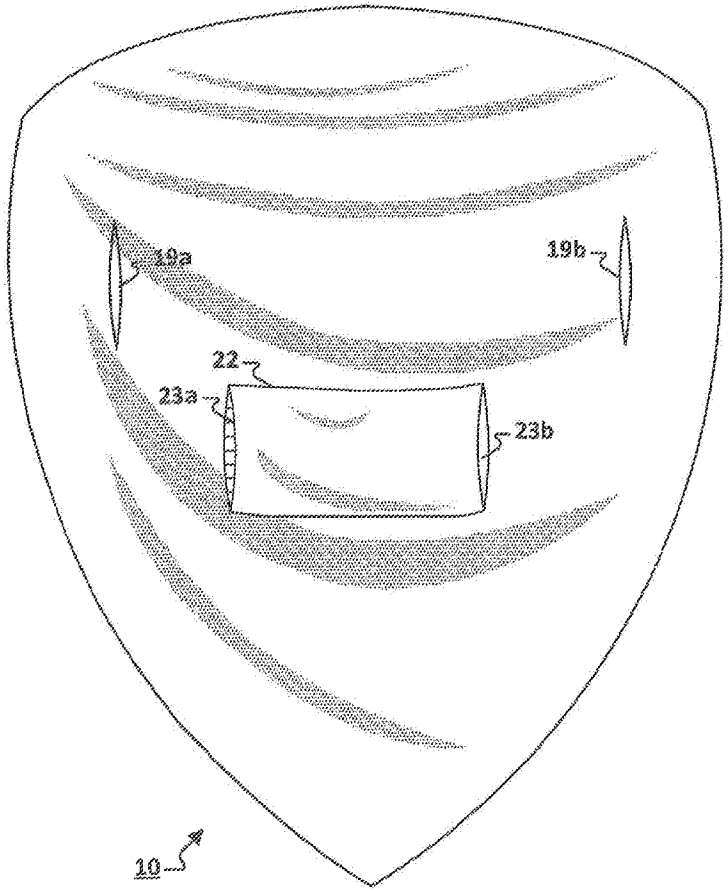
Figure 6B:
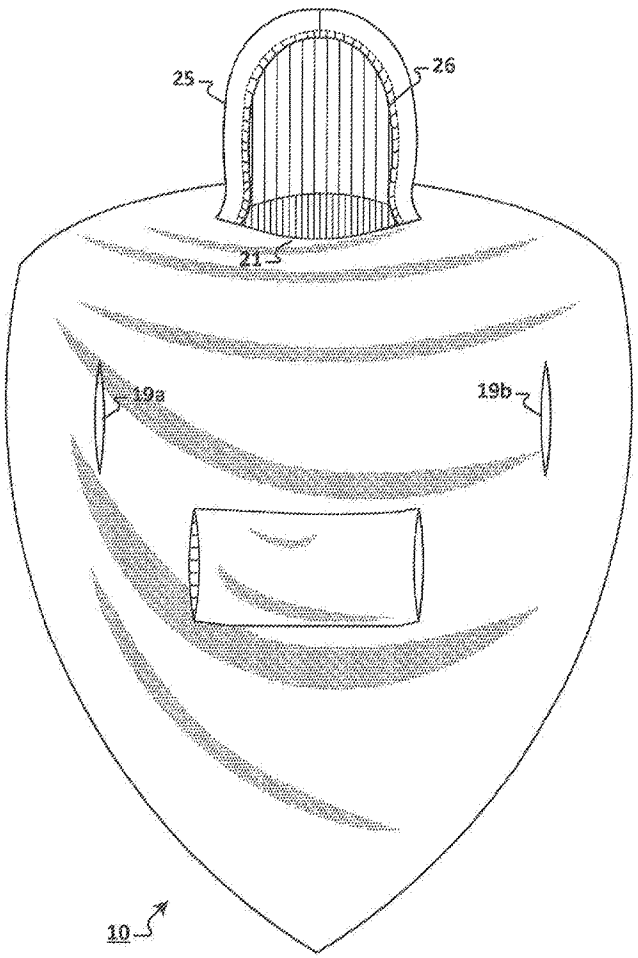
FIG. 6B shows the reverse side of the fitted blanket embodiment shown in FIG. 6A.
Figure 6A:
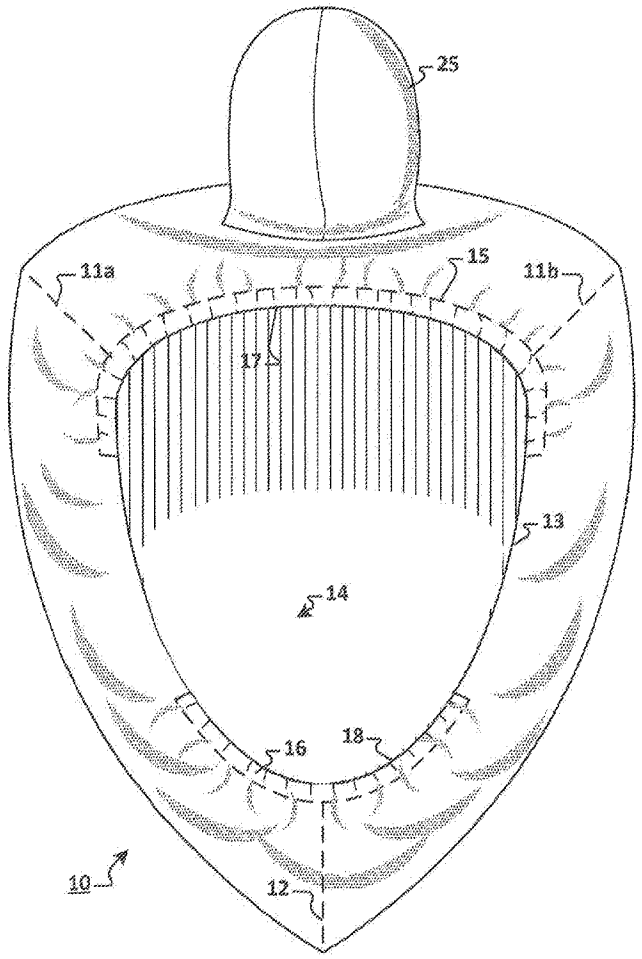
FIG. 6A shows the obverse side of another embodiment of a fitted blanket.

FIG. 5A shows an embodiment in which an elongated enclosure 22 having open ends 23*a, b* is incorporated into the blanket, while FIG. 5B shows a version having a pocket 24 formed on the blanket. FIGS. 6A & 6B illustrate an embodiment in which a hood 25 is attached to the upper portion of the blanket partially surrounding the opening 21. The hood 25 may include elastic 26 or a draw-string surrounding the opening of the hood 25.

As described above and shown in the associated drawings, the present invention comprises a fitted blanket. While particular embodiments have been described, it will be understood, however, that any invention appertaining to the fitted blanket described is not limited thereto, since modifications may be made by those skilled in the art, particularly in light of the foregoing teachings. It is, therefore, contemplated by the appended claims to cover an such modifications that incorporate those features or those improvements that embody the spirit and scope of the invention.

What is claimed is:

1. A fitted blanket comprising:

a generally curvilinear triangle-shaped bag comprising:

a front side and a back side defining an interior enclosure configured to fit a human body from shoulder to foot;

a generally oval opening defined in said back side, said oval opening having a perimeter including an elastic edge along an upper and lower portions of the perimeter;

a top portion comprising two shoulder areas; and a bottom portion comprising a foot area; and first and second openings defined in said front side.

2. The fitted blanket of claim 1, further comprising a top opening disposed between said two shoulder areas.

3. The fitted blanket of claim 2, wherein said top opening is a slit.

4. The fitted blanket of claim 3, further comprising a hood attached adjacent to the edges of said slit.

5. The fitted blanket of claim 2, further comprising a hood attached adjacent to the top opening.

6. The fitted blanket of claim 1, further comprising a pouch disposed on the front side thereof.

7. The fitted blanket of claim 6, wherein said pouch comprises an elongated enclosure having two lateral open ends.

8. The fitted blanket of claim 7, wherein said pouch comprises a pocket.

9. The fitted blanket of claim 1, wherein the upper portion of said perimeter further includes a cut-out defined in said perimeter.

* * * * *